United States Patent [19]

Aiuola et al.

[11] Patent Number: 4,669,249

[45] Date of Patent: Jun. 2, 1987

[54] WRAPPING BODIES E.G. SOAP

[75] Inventors: Franco Aiuola; Luciano Nannini, both of Bologna, Italy

[73] Assignee: Azionaria Costruzioni Macchine Automatiche, A.C.M.A. S.p.A., Bologna, Italy

[21] Appl. No.: 846,700

[22] Filed: Apr. 1, 1986

[30] Foreign Application Priority Data

Apr. 2, 1985 [IT] Italy ..... 3390 A/85

[51] Int. Cl.[4] ..... B65B 11/28

[52] U.S. Cl. ..... 53/234; 53/225; 198/404; 198/468.11

[58] Field of Search ..... 53/225, 234; 198/404, 198/468.11

[56] References Cited

U.S. PATENT DOCUMENTS

| | | | |
|---|---|---|---|
| 1,485,598 | 3/1924 | Croxford | 53/234 |
| 2,078,633 | 4/1937 | Huck | 53/234 X |
| 3,628,309 | 12/1971 | Seragnoli | 53/234 X |
| 4,073,123 | 2/1978 | Schoppee | 53/234 |

*Primary Examiner*—John Sipos

[57] ABSTRACT

A packaging machine for bodies of the type of soap comprises a drum (1) rotating intermittently by a half turn and having a housing (14) passing diametrically through it, which housing (14) is arranged to permit a block (15) to slide in it and, at each pause of the drum (1), is aligned with a station (2) for the insertion of a body (5) of the above-mentioned type and its associated wrapping element (4) and with an opposite ejection station (3). A reciprocating thrust element (23), carrying out this insertion, is connected by connecting means (26, 32, 34, 36, 22, 16) to cause the block (15) to slide in the housing (14) only during the insertion.

5 Claims, 8 Drawing Figures

WRAPPING BODIES E.G. SOAP

FIELD OF THE INVENTION

The present invention relates to a packaging machine for bodies of the type of soap.

BACKGROUND OF THE INVENTION

Packaging machines are available in which bodies of this type are individually wrapped and then sealed in wrapping elements, the wrapping element being formed in most cases by a piece of paper and in some cases by a piece of card as well.

A machine of this type is described in out British Patent Applications publication Nos. 2130544 and 2144702.

The machine described comprises a drum having a housing passing through it along a diameter, in which housing there is sufficient space for a single body of the above-mentioned type and a block. In this housing the block is frictionally mounted and can slide alternately from one end to the other along the housing. The drum rotates intermittently by a half turn about its axis and pauses after every half turn. During the pause one end of this housing faces an insertion station and the other end faces an ejection station. Wrapping elements are supplied sequentially to the insertion station in a substantially tangential position with respect to the drum and a body to be wrapped is also supplied adjacent to the said element. A reciprocating thrust element is provided at the insertion station, which pushes the body against the wrapping element during its operational stroke and then, as the drum is stationary, inserts it into the drum housing in such a way that a wrapping blank is obtained around the said body: the action which the thrust element exerts on the body to be wrapped is gradually transmitted to the wrapping element, to the block and to the body which, during the previous pause of the drum, has been partially wrapped and is still located within the housing, adjacent the ejection station.

It is evident therefore that the thrust element alone provides the drive causing the block to slide in the drum housing i.e. to slide from the end of the housing facing the insertion station to the opposite end facing the ejection station, through the body to be wrapped; in other words causing the ejection of the body which has previously been partially wrapped by introduction of the next body to be wrapped, into the housing. Consequently in the normal operation of the packaging machine it is necessary to maintain absolute regularity of supply to the insertion station, whilst provision has to be made to slide the block in the housing manually, to eject a body remaining in the drum at a transitional stage.

It is also obvious that the body to be wrapped is subjected to considerable force in order to cause the wrapping element to fold around it and in particular to displace the block and the previous partially wrapped body. The body to be wrapped can only withstand this force satisfactorily if it is sufficiently rigid and square. An oval body of the consistency of soap would be damaged if its smaller zones were to be acted upon by the thrust element and if it were also to operate the block.

OBJECTS OF THE INVENTION

An object of the invention is therefore to provide an improved packaging machine, generally of the type described in the above-mentioned patents, in which the bodies to be wrapped are subjected to minimal force on insertion into the drum.

SUMMARY OF THE INVENTION

The above and other objects are achieved according to the invention by a machine for packaging bodies, for example tablets of soap, which comprises a drum rotatable intermittently by a half turn about its axis, an insertion station to which there is supplied every half turn a wrapping element in a substantially tangential position with respect to the drum and, adjacent to the said element, to which is also supplied a body to be wrapped, a housing extending diametrically through the drum and arranged every half turn of the drum, to pause in alignment with the insertion station and with an ejection station disposed at the diametrically opposite side of the drum to the insertion station, a block mounted on slide in this housing in a frictional manner leaving enough space in the housing for a single body, a reciprocating thrust element mounted for operation at the insertion station and adapted, during its operational stroke, to push the body to be wrapped against a wrapping element positioned tangentially to the drum as aforementioned and then to insert both the element and the body into the housing during the pause in the rotation of the drum, the construction and arrangement of the machine being such that during insertion the block and the thrust element are interconnected so that they slide together, the block facing this insertion station at the time of insertion.

A machine according to the invention preferably comprises connection means interconnecting the block and thrust element so that they slide in unison during insertion of a body into the housing whereby the block ejects from the housing into the ejection station the preceding partially wrapped body, the connection means, however, permitting the thrust element to subsequently be retracted without moving the block. Conveniently the connection means comprises a first rocker arm disposed at the insertion station to support the reciprocating thrust element and adapted to move the thrust element towards and away from the drum, a second rocker arm disposed at the ejection station, a link rod connected to both the second rocker arm and the block, a connecting rod connected to both the first and the second rocker arms, one of these connections being such that the transmission of motion from the first rocker arm to the block takes place only during insertion and in the direction of insertion, and does not occur when the thrust element pushes the body to be wrapped against the wrapping element nor whilst the drum rotates.

BRIEF DESCRIPTION OF THE DRAWINGS

There now follows a detailed description to be read with reference to the accompanying drawings of a packaging machine for bodies of the type of soap, embodying the invention. It will be realised that this machine has been selected for description by way of example.

In the accompanying drawings.

DESCRIPTION OF THE PREFERRED EMBODIMENT

Figure 1A:
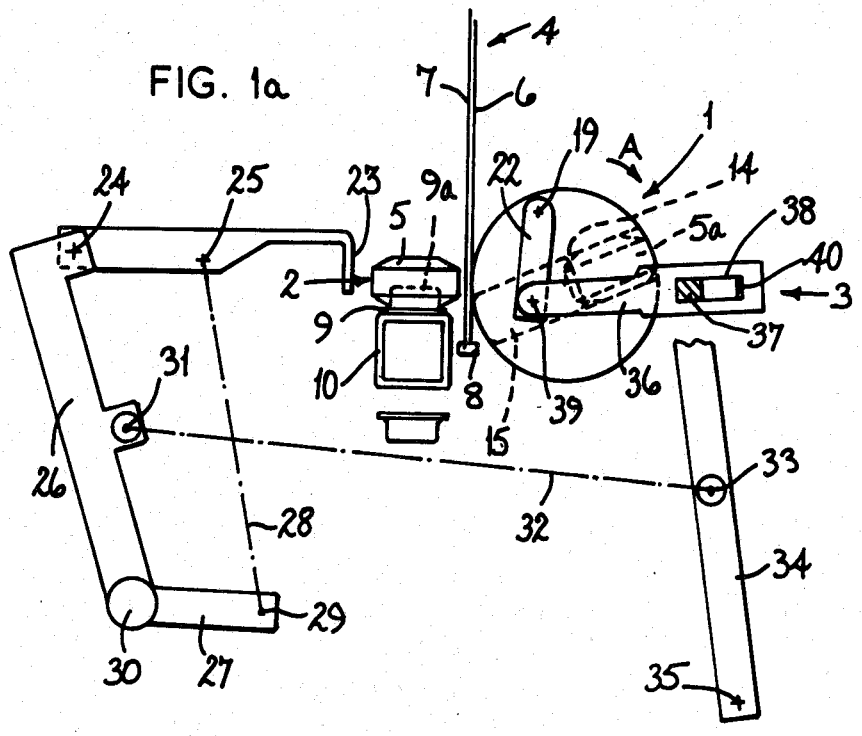
FIGS. 1*a* to 1*e* are views in elevation of a packaging machine embodying the invention showing a sequence of operational stages of the machine in diagram form.

The packaging machine embodying the invention shown in the drawings comprises a drum 1 which has a horizontal axis and is arranged to rotate intermittently by a half turn about this axis in the direction of the arrow A. The drum 1 is disposed between an insertion station 2 and an ejection station 3 which are disposed at opposite sides of the drum in a common plane with the axis of the drum and substantially horizontal. At every half turn of the drum, wrapping elements 4 and a body 5 to be wrapped are supplied to the station 2.

The element 4 may consist of a single piece of paper, or may (as shown in FIG. 1) comprises a piece of paper 6 and a piece of card 7 which can be shaped so as to provide when appropriately folded, a parallelepipedic box. During the wrapping of the body 5, the paper 6 is intended to remain on the outside of the wrapping and the card 7 substantially within the paper wrapping. When the bodies 5 to be wrapped are soaps of substantially oval shape, it is particularly preferred for the card 7 to be pre-folded and thus weakened at its creases before being assembled with the piece of paper 6, conveniently in a suitable aparatus, for example the apparatus disclosed in our copending patent application No.

In practice, the flat wrapping element 4 is supplied downwardly at 2 and is disposed with its lower edge supported on a support 8 and with one of its faces substantially tangential to the drum 1 (if the wrapping element 4 comprises paper 6 and card 7, the paper 6 faces the drum). A body 5 is delivered to a position adjacent to this wrapping element 4 on an upper branch of a belt 9 of a conveyor of the endless belt type; (the belt 9 passes round a drive pulley and a return pulley not shown) and extends parallel to the axis of the drum 1. The conveyor belt 9 has external teeth 9*a* which are transverse to the belt and are distributed at a uniform pitch along the belt. Between two adjacent teeth 9*a* there is thus formed a pocket arranged to snugly receive a body 5. The upper branch of the belt 9 slides on a profiled support section 10 and advances by one step at a time, intermittently towards the drum, the upper branch ending adjacent the drum; the length of each step of the belt is the same as the distance between the centres of adjacent pockets of the belt 9.

Figure 3:
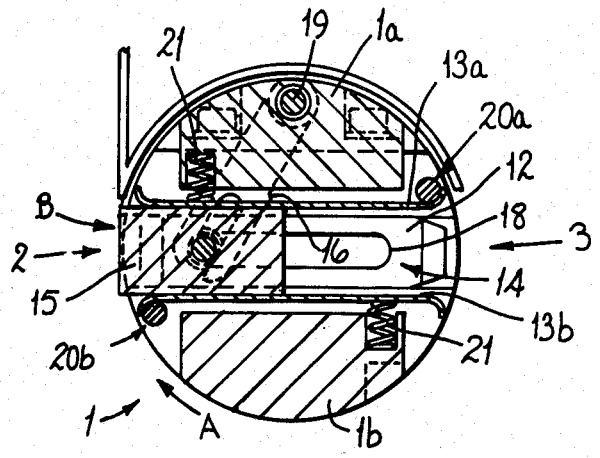
FIG. 3 is a transverse vertical section through a drum of the machine.
Figure 4:
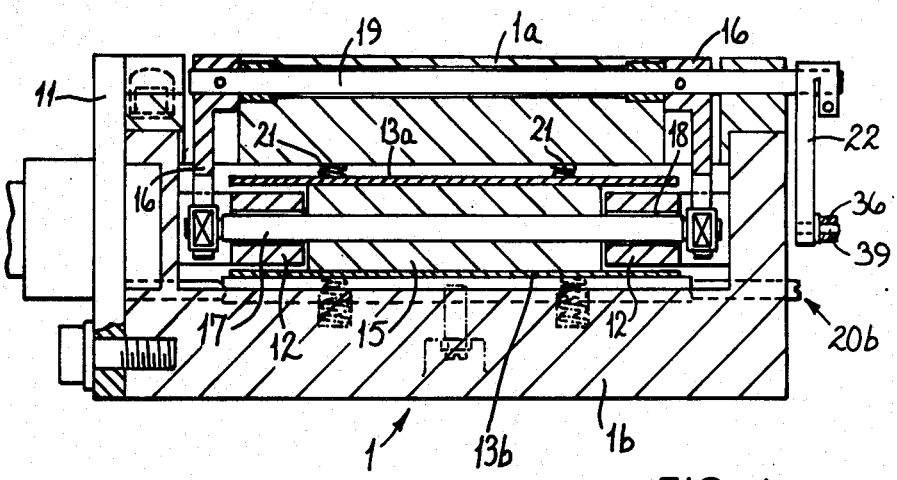
FIG. 4 is a longitudinal section through the drum.

The construction of the drum 1 is substantially the same as that described in the above-mentioned Patent Application publication No. 2130544. The drum (see FIGS. 3 and 4) comprises two portions 1*a* and 1*b* and a support head 11 (on which the portions 1*a*, 1*b* are mounted) which is connected to an associated unit which provides the drum with its intermittent movement. The two portions 1*a* and 1*b* define a passage which is diametrical with respect to the drum and in which two small shaped blocks 12 and two opposite plate elements 13*a* and 13*b* together define a housing 14 which also passes diametrically through the drum and in which a block 15 slides. Each block 12 is fixed to the portion 1*b* in such a way as to leave a space into which a forked end of an associated arm 16 penetrates. By means of this end the arms 16 are coupled to the ends of a pin 17 which project from the sides of the block 15 and pass through slots 18 in the blocks 12. At the other end the arms 16 are fixed to a pin 19 which is mounted in the portion 1*a* to rotate about an axis parallel to the axis of the drum 1, the axes of the pin and the drum being in a plane perpendicular to the plane of the housing 14. The pin 19 projects from the drum 1 from the side opposite to the head 11 and an arm 22 is rigidly fixed to this projecting part of the pin 19, the arm 22 being in a common plane with the other two arms 16.

The plate elements 13*a*, 13*b* are mounted for pivotal movement about pivots 20*a*, 20*b* in the portion 1*b* of the drum 1. The plate elements 13*a* and 13*b* are urged against the block 15 by springs 21. The block 15 can therefore slide in a frictional manner along the housing 14. Inside the housing 14, the block leaves sufficient space for a single body 5 to be accommodated within the housing 14 at one end when the block 15 is at the other end of the housing 14. At each pause of the drum the housing 14 is aligned with the stations 2 and 3.

At the insertion station 2 a reciprocating thrust element 23 operates (FIG. 1), whose operational insertion stroke, moving towards the drum 1 takes place in the direction of the arrow B. It is advantageous for the thrust element to have a complex alternating movement, i.e. a movement containing both horizontal and vertical components which, as will be explained below, are designated by SO and SV in FIG. 2 and can be seen in FIG. 1. The thrust element 23 is a projecting portion of a connecting rod member which, at pivot points 24, 25, respectively is carried by a rocker arm 26 and a linkage. This linkage comprises an arm 27 and a rod 28 which are connected at pivot point 29. The rocker arm 26 and a lower end of the arm 27 are mounted to pivot independently on a single pin 30 supported by the frame of the machine. The oscillations of the arm 27 and the rocker arm 26 are controlled by suitable means, preferably eccentric or cam means (not shown) similar to those shown in the above-mentioned Patent Application Publication No. 2130544.

Between the thrust element 23 and the block 15 there is a connection as a result of which, as will be explained in detail below the block 15 is provided with the same horizontal operating stroke as the thrust element. The rocker arm 26, which is arranged to operate the thrust element 23 in its movement towards and away from the drum 1, therefore also provides the intermittent operation of the block 15. The first rocker arm 26 is connected at connection 31 with a connecting rod 32 which is connected at connection 33 with a second rocker arm 34. The rocker arm 34 is disposed below the ejection station 3 and has its lower end pivotally mounted on the frame of the machine at pivot point 35. A link rod 36 connects the upper end of the second rocker arm 34 and the arm 22. One of the connections mentioned above is of the sliding pivot link type, (which may be referred to as a sliding crank link) permitting both pivotal movement and some linear movement whilst the others are simple pivot points. It is therefore preferable for the upper end portion of the rocker arm 34 to be pivotally connected by pivot 37*a* to a slide 37 sliding in a slideway 38 which is provided on the link rod 36 near one of its ends. The other end of the link rod 36 is pivotally connected by pivot 39 to the arm 22. The end of the slideway 38 remote from the station 2 has a resilient stop 40 against which, as will be shown below, the slide 37 abuts when the drive is transmitted from the first rocker arm 26 to the block 15.

Figure 1B:
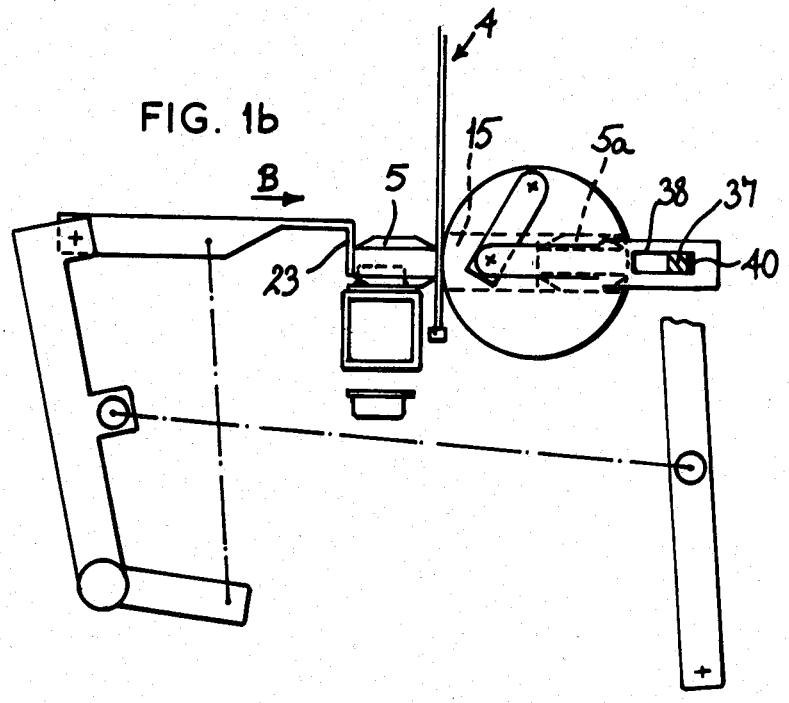
Figure 1C:
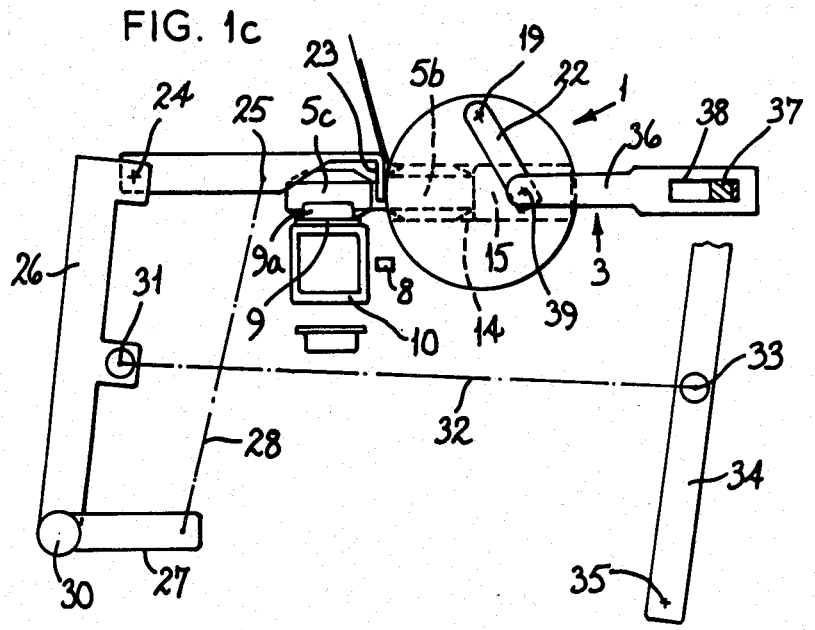

The operation of the machine will now be described with reference to FIGS. 1 and 2. In FIG. 2 the same reference letters used as subscripts in FIG. 1 are given to corresponding vertical reference lines.

When the thrust element 23 begins its operational stroke (section SO1 of the diagram SO), it has already performed, under the control of the linkage comprising the arm 27 and rod 28, its descent (section SV1 of SV) to the level of the upper branch of the conveyor belt 9. At the same time the drum has almost completed a rotation through 180° (section T1) bringing the block 15 to face the insertion station 2, and the belt 9 has almost completed its forward movement by one step (section N1) as a result of which a body 5 to be wrapped has almost reached the station 2 adjacent to a wrapping element 4 supported on the support 8. As can be seen from FIG. 1*a*, between the thrust element and the body 5 to be wrapped and between this body and the element 4 there are adequate spaces. It can also be seen that the slide 37 is at the end of the slideway 38 closest to the station 2. A first portion of the operating stroke of the thrust element 23 is then arranged to ensure that the element 23 comes into contact with the body 5 to be wrapped and then, when the descent of the thrust element is complete and the belt 9 has moved forward, to urge the body 5 against the wrapping element 4 and against the facing edge of the block 15, the drum 1 then being motionless. In this first part of the operational stroke of the thrust element 23, the rocker arm 26 does not cause any sliding of the block 15 which is frictionally mounted in the housing 14 and remains stationary. In effect the angular stroke of the rocker arm 26 and the consequent stroke of the rocker arm 34 only cause the slide 37 to slide in the link 38 up to the resilient stop 40 (FIG. 1*b*).

The drum 1 remains motionless (section T2) for the remainder of the operating stroke of the thrust element 23, towards the end of which the thrust element moved horizontally (section SV2). The pause (section N2) of the belt 9 ends before the end of the operating stroke of the thrust element. Over the remaining operating stroke, the thrust element causes the body 5 to be inserted in the housing 14 with a portion of the wrapping element 4 which is wrapped about the body 5. The block 15 follows the sliding movement of the thrust element 23 at the same rate: during the final angular stroke of the rocker arm 34, connected to the rocker arm 26, the slide 37 drags the link rod 36 which causes the arm 22, and thus the arms 16, to rotate and therefore causes the block 15 to slide in the housing 14 until it faces the station 3 (FIG. 1*c*). By means of this sliding movement of the block 15, the body 5*a* previously partially wrapped in the preceding cycle is ejected from the housing 14. At the station 3, the body 5*a* is collected in a transfer device preferably comprising a resilient hopper of the type described in the above-mentioned Patent Application publication No. *2144702*. It should be noted that the body 5*b* inserted by the thrust element 23 does not take an active part in the displacement of the block 15 and the ejection of the body 5*a* and is not therefore subjected to substantial force. It should also be noted that, even in the absence of the body 5*b*, the block 15 would also have ejected the body 5*a given that its displacement depends on the thrust element 23 and not on the the body 5b.*

Figure 1D:
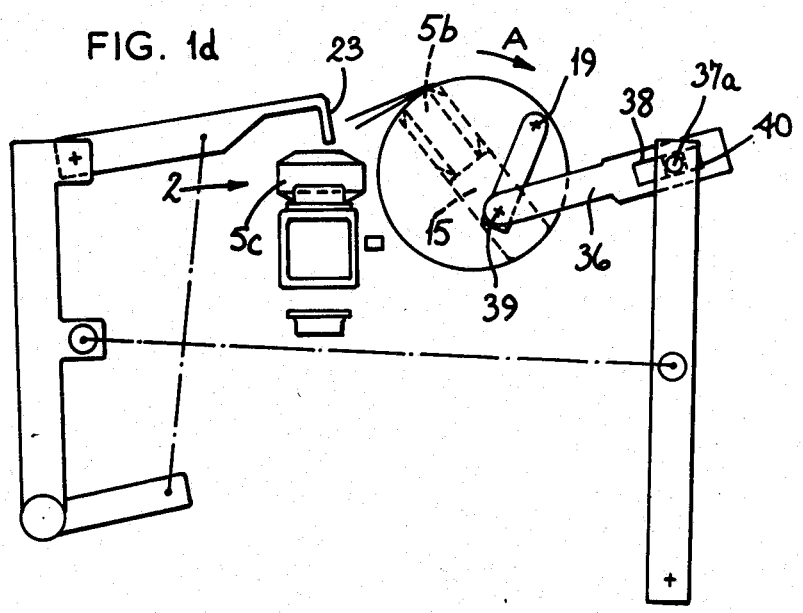

As shown in FIG. 1*d*, during its stroke moving away from the drum (section SO2), the thrust element 23 continues to rise (section SV3) so as to reach a level above the new body 5*c* which is being delivered to the station 2 by the belt 9, and then remains at this level for a short time (section SV4) after which it begins to descend again. At the beginning of the return stroke of the thrust element 23, the drum 1 also begins to rotate. Throughout the entire rotation of the drum, the block 15 does not slide in the housing 14 in which it is frictionally mounted, and the body located in the housing does not slide either. In effect during the transition from the position shown in FIG. 1*c* to the position of FIG. 1*e*, the rocker arm 34 and the slide 37 are displaced in a direction towards the station 2, and the link rod 36 is displaced in the same direction urged by the arm 22 (to which the rod 36 is connected by the pivot 39) of the arm assembly 22, 16, which assembly does not rotate with respect to the drum 1 but rotates with the drum. As shown in FIG. 1*d*, during the transition between the two above positions, the slide 37 slides in the slideway 38 from the end of the link provided with the resilient stop 40 to the other end.

Figure 1E:
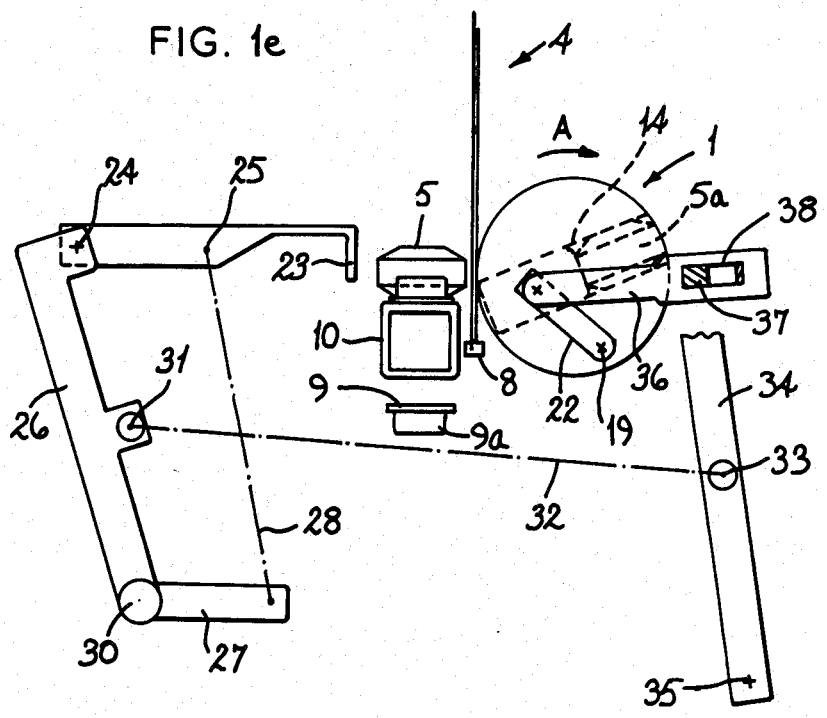
Figure 2:
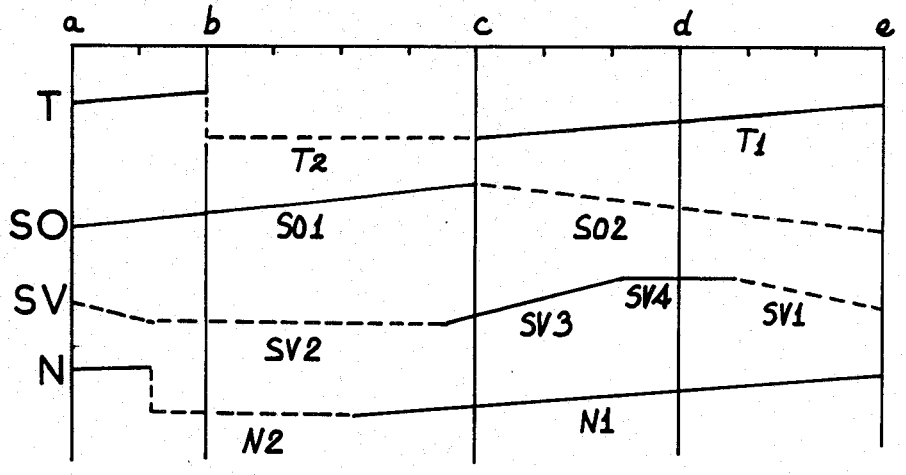
FIG. 2 shows the operational sequence of the machine in diagram form.

Consequently the position of FIG. 1*e* is operationally identical to FIG. 1*a*. The only difference between these two drawings is that the pin 19 is in a diametrically opposite position with respect to the axis of the drum 1. The pin 19 returns to the position in which it is shown in FIG. 1*a* from the position of FIG. 1*e* after a further cycle of the machine, i.e. after the drum has rotated through 180°.

The illustrative machine is thus so constructed and arranged that during insertion of the body 5 to be wrapped into the housing 14 the block 15 and thrust element 23 are interconnected so that they slide together (in unison), so that the block 15 at the same time ejects from the housing 14 the previous partially wrapped body 5. The construction and arrangement is further such that rotation of the drum 1 can commence substantially immediately that insertion of a new body to be wrapped and ejection of the previous body has taken place, it being unnecessary to await retraction of the thrust element or ejection mechanism before rotation of the drum commences, thus permitting a very rapid cycle time for the machine. In addition, as mentioned above and seen from FIG. 2 the conveyor belt 9 can commence its feed step before the insertion stroke of the thrust element 23 is complete, thanks to the cutaway shaping of the operative end portion of the element 23 (which allows the teeth 9*a* of the belt to pass beneath the element 23 as the element 23 approaches completion of the insertion stroke) and the linkage which raises the element 23 so that is passes above the belt 9 (and articles 5 carried thereby) as it is retracted.

In the machine as described above bodies to be wrapped are subject to minimal forces on insertion into the drum and the machine is simple, convenient and operates efficiently.

Having thus described out invention and the manner in which it is to be performed, what we claim as new and desire to secure by letters Patent of the United States is:

1. A machine for packaging bodies, which comprises a drum rotatable intermittently by half turn about its axis, an insertion station to which there is supplied every half turn a wrapping element in a substantially tangential position with respect to the drum and, adjacent to the said element, to which is also supplied a body to be wrapped, a housing extending diametrically through the drum and arranged every half turn of the drum, to pause in alignment with the insertion station and with an ejection station disposed at the diametrically opposite side of the drum to the insertion station, a block mounted to slide in this housing in a frictional manner leaving enough space in the housing for a single body, a reciprocating thrust element mounted for operation at the insertion station and adapted, during its operational stoke, to push the body to be wrapped against a wrapping element positioned tangentially to the drum as aforesaid and then to insert both the element and the body into the housing during the pause in the rotation of the drum, the construction and arrangement of the machine being such that during insertion the block and the thrust element are interconnected so that they slide together, the block facing the insertion station at the time of insertion, the block and the thrust element are connected by conntection means which comprises a first rocker arm disposed at the insertion station to support the reciprocating thrust element and adapted to move the thrust element towards and away from the drum, a second rocker arm disposed at the ejection station, a link rod connected to both the second rocker arm and the block, a connecting rod connected to both the first and the second rocker arms, one of these connections being such that the transmission of motion from the first rocker arm to the block takes place only during insertion and in the direction of insertion, and does not occur when the thrust element pushes the body to be wrapped against the wrapping element nor whilst the drum rotates.

2. A machine according to claim 1 wherein said one of these connections comprises a link including a pivot and slide and wherein said transmission takes place only when the slide is at one end of its sliding motion.

3. A machine according to claim 1 in which the connection means comprises a pin, mounted for rotation in the drum about an axis parallel to the axis of the drum and integral with three arms, one of which is external to the drum and is connected to the link rod, whilst the other two are disposed within the drum and are coupled to opposite ends of the block.

4. A machine according to claim 3 in which the bodies to be wrapped are supplied to the insertion station by a conveyor which extends parallel to the axis of the drum, has uniformly spaced external teeth, pockets for the bodies to be wrapped being defined between adjacent teeth, the conveyor being arranged to move with an intermittent step movement, each step being of the same length as the distance between the centres of adjacent ones of the pockets of the belt.

5. A machine according to claim 4, wherein in addition to the first rocker arm, the reciprocating thrust element is also supported by a linkage which during the return movement from the position in which the element is close to the drum to the initial position in which the thrust element is remote from the drum, is arranged to lift the thrust element into a position above the conveyor and then lower the element to the level of the conveyor.

* * * * *